US006045004A

United States Patent [19]

Elliott

[11] Patent Number: 6,045,004

[45] Date of Patent: Apr. 4, 2000

[54] DISPENSING STRUCTURE WITH DISPENSING VALVE AND BARRIER PENETRATOR

[75] Inventor: John Elliott, Burlington, Wis.

[73] Assignee: AptarGroup, Inc., Crystal Lake, Ill.

[21] Appl. No.: 09/045,274

[22] Filed: Mar. 20, 1998

[51] Int. Cl.[7] ..... B67D 5/00; B65D 5/72; B65D 47/06

[52] U.S. Cl. ..... 222/83; 222/494; 222/556

[58] Field of Search ..... 222/83, 81, 83.5, 222/88, 182, 490, 494, 556

[56] References Cited

U.S. PATENT DOCUMENTS

| | | | |
|---|---|---|---|
| Re. 29,850 | 11/1978 | Labarre . | |
| 741,307 | 10/1903 | Chapman . | |
| 1,999,154 | 4/1935 | Pisow . | |
| 2,550,132 | 4/1951 | Woods . | |
| 2,668,428 | 9/1954 | Manhartsberger . | |
| 2,688,428 | 9/1954 | Manhartsberger . | |
| 2,895,654 | 7/1959 | Rieke . | |
| 3,043,483 | 7/1962 | Vogt . | |
| 3,135,441 | 6/1964 | Wise et al. . | |
| 3,187,918 | 6/1965 | Moore | 222/83 |
| 3,200,995 | 8/1965 | Gangwisch . | |
| 3,207,375 | 9/1965 | Bereziat et al. . | |
| 3,239,112 | 3/1966 | Porcelli . | |
| 3,269,617 | 8/1966 | Goth . | |
| 3,278,089 | 10/1966 | Heekin et al. . | |
| 3,282,477 | 11/1966 | Henchert . | |
| 3,292,828 | 12/1966 | Stuart . | |
| 3,310,206 | 3/1967 | Littlefield . | |
| 3,402,855 | 9/1968 | Schroeder et al. . | |
| 3,406,872 | 10/1968 | Fiquet et al. . | |
| 3,434,620 | 3/1969 | Laurizio . | |
| 3,458,080 | 7/1969 | Laurizio . | |
| 3,459,315 | 8/1969 | Labarre . | |
| 3,495,746 | 2/1970 | Laurizio . | |
| 3,567,061 | 3/1971 | Song . | |
| 3,580,423 | 5/1971 | Gilman . | |
| 3,587,937 | 6/1971 | Childs . | |
| 3,610,484 | 10/1971 | Matzka . | |
| 3,613,955 | 10/1971 | Wetherell, Jr. . | |
| 3,632,006 | 1/1972 | Gilson . | |
| 3,661,306 | 5/1972 | Kuckens . | |
| 3,834,597 | 9/1974 | Guala . | |
| 3,860,152 | 1/1975 | Marti . | |
| 3,912,115 | 10/1975 | Smith . | |
| 3,924,777 | 12/1975 | Peyser . | |

(List continued on next page.)

FOREIGN PATENT DOCUMENTS

| | | |
|---|---|---|
| 570 276 A1 | 11/1993 | European Pat. Off. . |
| 747 294 A1 | 12/1996 | European Pat. Off. . |
| WO 95/28274 | 10/1995 | WIPO . |
| WO 96/14249 | 5/1996 | WIPO . |
| WO 96/24483 | 8/1996 | WIPO . |
| WO 97/00816 | 1/1997 | WIPO . |
| WO 97/05055 | 2/1997 | WIPO . |

OTHER PUBLICATIONS

"Multi–Material Injection Saves Time, While Cutting Costs," Modern Plastics, Mar. 19, 1994 (Author: Peter Mapleston).

(List continued on next page.)

*Primary Examiner*—Andres Kashnikow
*Assistant Examiner*—Keats Quinalty
*Attorney, Agent, or Firm*—Rockey, Milnamow & Katz, Ltd.

[57] ABSTRACT

A dispensing structure is provided for a container that has an opening to the container interior. A membrane initially occludes the container opening. A cover extends over the container opening and over the membrane. The cover has a peripheral frame and a panel that is connected to the frame. The panel has a dome-like, outwardly convex configuration defining a dispensing aperture and is normally biased outwardly. The panel can be moved to an inverted, inwardly concave configuration. A dispensing valve is disposed in the cover across the dispensing aperture. A penetrator extends from the panel inwardly of the dispensing valve for penetrating the membrane when the panel is in the inwardly concave configuration.

46 Claims, 4 Drawing Sheets

U.S. PATENT DOCUMENTS

| | | | |
|---|---|---|---|
| 3,949,898 | 4/1976 | Patel et al. . | |
| 3,990,603 | 11/1976 | Brochman . | |
| 4,022,357 | 5/1977 | Dwinell . | |
| 4,179,044 | 12/1979 | Fitte . | |
| 4,211,334 | 7/1980 | Witten et al. . | |
| 4,234,103 | 11/1980 | Strobl et al. | 222/83.5 |
| 4,294,382 | 10/1981 | Summers et al. . | |
| 4,307,821 | 12/1981 | McIntosh . | |
| 4,340,147 | 7/1982 | McIntosh . | |
| 4,356,939 | 11/1982 | Fitte . | |
| 4,440,310 | 4/1984 | Heyn . | |
| 4,469,249 | 9/1984 | Malpas et al. . | |
| 4,483,464 | 11/1984 | Nomura . | |
| 4,583,665 | 4/1986 | Barriac . | |
| 4,616,768 | 10/1986 | Flier . | |
| 4,640,424 | 2/1987 | White . | |
| 4,646,945 | 3/1987 | Steiner et al. . | |
| 4,682,702 | 7/1987 | Gach . | |
| 4,696,415 | 9/1987 | Meshberg | 222/83 |
| 4,706,827 | 11/1987 | Cabernoch et al. . | |
| 4,709,822 | 12/1987 | Vataru . | |
| 4,722,449 | 2/1988 | Dubach . | |
| 4,727,999 | 3/1988 | Gach . | |
| 4,728,006 | 3/1988 | Drobish et al. . | |
| 4,747,501 | 5/1988 | Greaves . | |
| 4,747,511 | 5/1988 | Dutt et al. . | |
| 4,749,108 | 6/1988 | Dornsbusch et al. . | |
| 4,770,305 | 9/1988 | Su . | |
| 4,785,931 | 11/1988 | Weir et al. . | |
| 4,795,043 | 1/1989 | Odet et al. . | |
| 4,807,769 | 2/1989 | Gach . | |
| 4,817,816 | 4/1989 | Leseman et al. . | |
| 4,838,441 | 6/1989 | Chernack . | |
| 4,846,236 | 7/1989 | Deruntz . | |
| 4,867,326 | 9/1989 | O'Meara . | |
| 4,869,399 | 9/1989 | Dubach . | |
| 4,884,705 | 12/1989 | Debetencourt . | |
| 4,909,434 | 3/1990 | Jones et al. . | |
| 4,948,003 | 8/1990 | Munoz . | |
| 4,969,581 | 11/1990 | Seifert et al. . | |
| 4,993,569 | 2/1991 | Osip et al. . | |
| 5,005,737 | 4/1991 | Rohr . | |
| 5,008,066 | 4/1991 | Mueller . | |
| 5,022,562 | 6/1991 | Lurkis et al. . | |
| 5,042,690 | 8/1991 | O'Meara . | |
| 5,082,136 | 1/1992 | Schumann . | |
| 5,090,582 | 2/1992 | Art et al. . | |
| 5,094,361 | 3/1992 | Dubach . | |
| 5,115,950 | 5/1992 | Rohr . | |
| 5,133,486 | 7/1992 | Moore et al. . | |
| 5,213,236 | 5/1993 | Brown et al. . | |
| 5,255,812 | 10/1993 | Hsu . | |
| 5,271,531 | 12/1993 | Rohr et al. . | |
| 5,292,025 | 3/1994 | Dubreul . | |
| 5,356,018 | 10/1994 | Dubach . | |
| 5,386,918 | 2/1995 | Neveras . | |
| 5,400,912 | 3/1995 | Brown et al. . | |
| 5,427,260 | 6/1995 | Mueller et al. . | |
| 5,437,382 | 8/1995 | Gluckman . | |
| 5,439,124 | 8/1995 | Mock . | |
| 5,439,143 | 8/1995 | Brown et al. . | |
| 5,462,200 | 10/1995 | Weiler . | |
| 5,469,980 | 11/1995 | O'Meara et al. . | |
| 5,482,176 | 1/1996 | Maietta et al. . | |
| 5,501,348 | 3/1996 | Takeuchi . | |
| 5,503,282 | 4/1996 | Montgomery . | |
| 5,505,326 | 4/1996 | Junko . | |
| 5,531,363 | 7/1996 | Gross et al. . | |
| 5,547,091 | 8/1996 | Neveras et al. . | |
| 5,560,505 | 1/1906 | Scheneider et al. . | |
| 5,566,859 | 10/1996 | Willis et al. . | |
| 5,590,798 | 1/1997 | O'Connell . | |
| 5,642,824 | 7/1997 | Hess, III et al. . | |
| 5,711,453 | 1/1998 | Weiler . | |
| 5,769,277 | 6/1998 | Elliott . | |
| 5,853,109 | 12/1998 | Elliott | 222/83 |

OTHER PUBLICATIONS

"Molding Many Parts Into One," Product Design and Development, Dec. 19, 1995, p. 16 (Author: Jay Rosenberg).

A copy of 2 photographs of a closure specimen, one photograph showing a top perspective view with the closure open, and the other photograph showing a bottom perspective view with the closure open.

FIG. 1
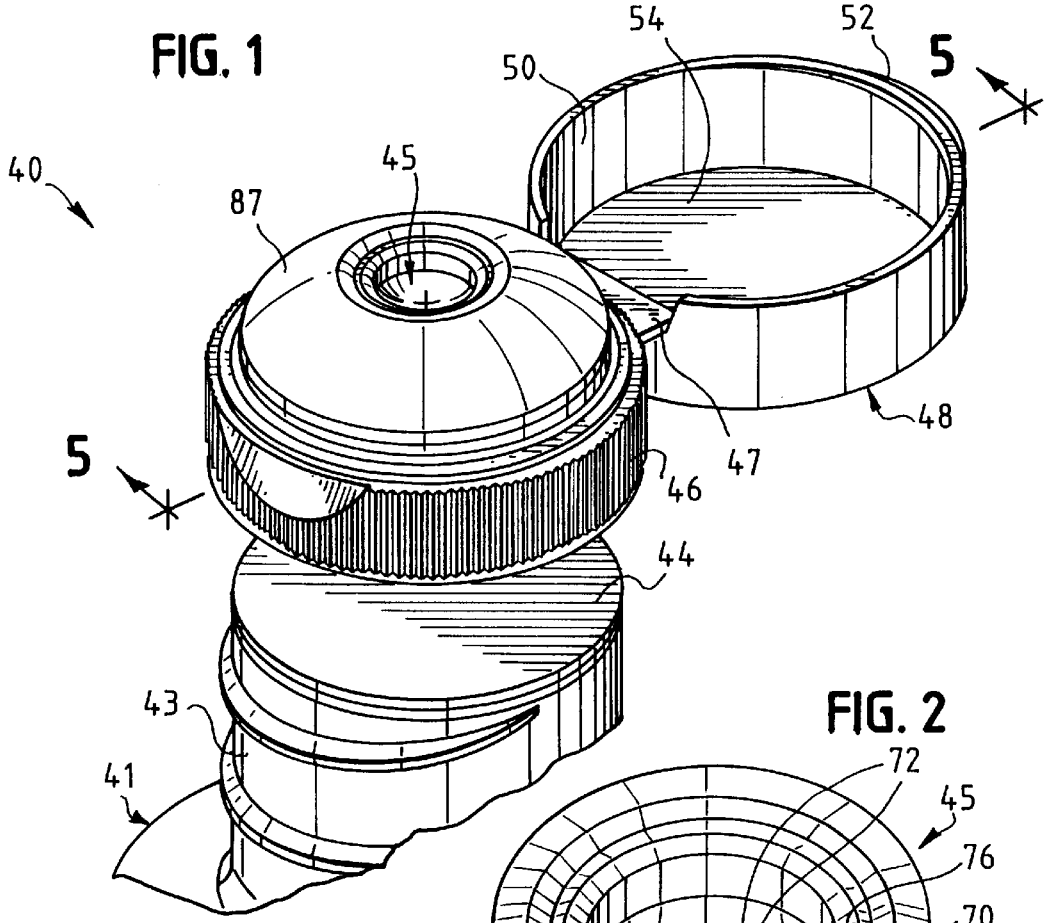
FIG. 2
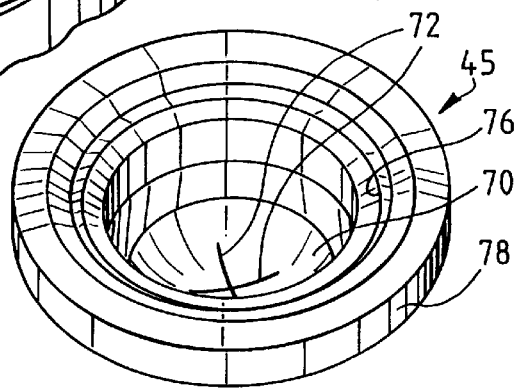
FIG. 3
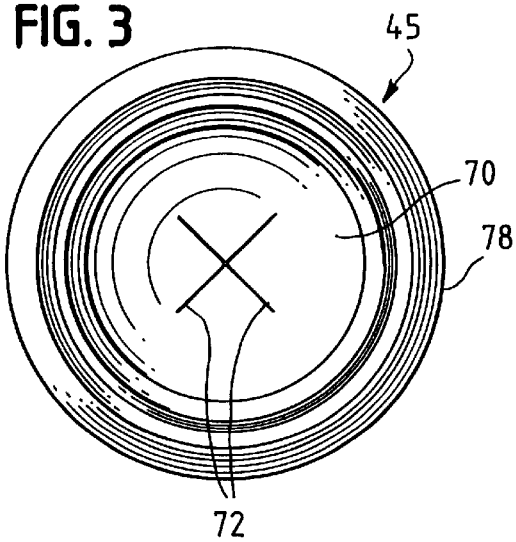
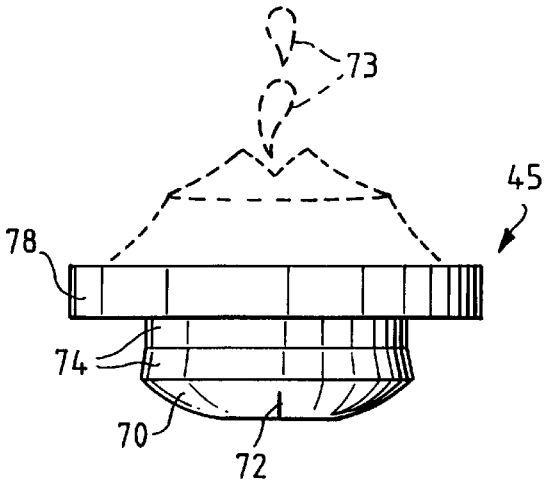
FIG. 4

FIG. 8
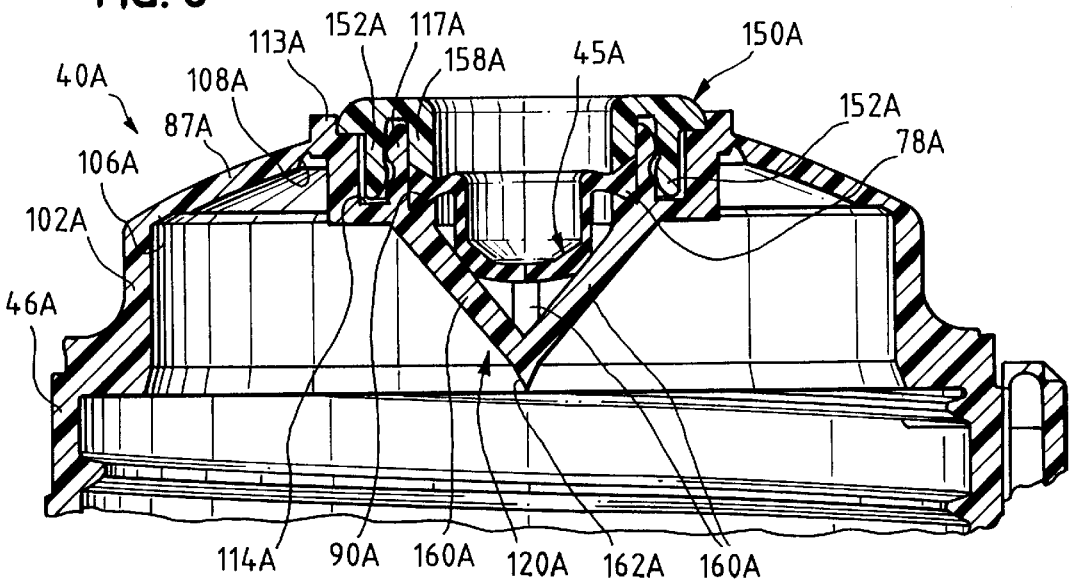
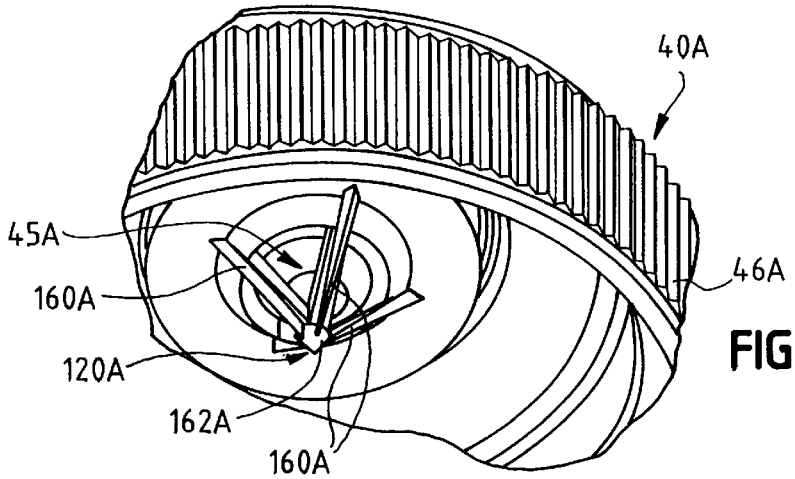
FIG. 9
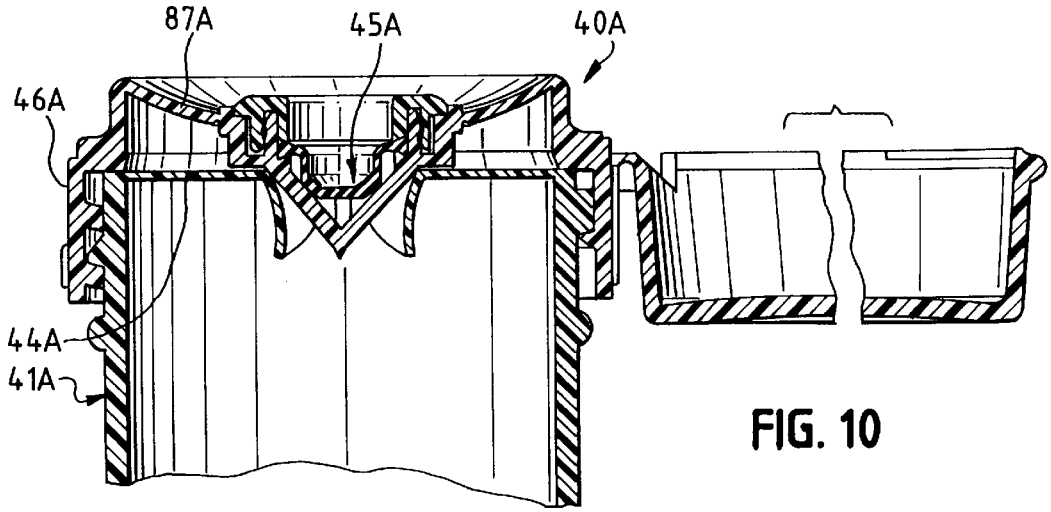
FIG. 10

DISPENSING STRUCTURE WITH DISPENSING VALVE AND BARRIER PENETRATOR

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system for dispensing a product from a container. The invention is more particularly related to a system incorporating a dispensing valve which is especially suitable for use with a squeeze-type container wherein a product can be discharged from the container through the valve when the container is squeezed.

BACKGROUND OF THE INVENTION AND TECHNICAL PROBLEMS POSED BY THE PRIOR ART

A variety of packages, including dispensing packages or containers, have been developed for personal care products such as shampoo, lotions, etc., as well as for other materials. Such containers typically have a neck defining an open upper end on which is mounted a dispensing closure. One type of dispensing closure for these kinds of containers has a flexible, pressure-openable, self-sealing, slit-type dispensing valve mounted in the closure over the container opening. When the container is squeezed, the valve slits open, and the fluid contents of the container are discharged through the open slits of the valve. The valve automatically closes to shut off fluid flow therethrough upon removal of the increased pressure.

Designs of closures using such valves are illustrated in the U.S. Pat. Nos. 5,271,531 and 5,033,655. Typically, the closure includes a body mounted on the container neck to hold the valve over the container opening.

A lid can be provided for covering the valve during shipping and when the container is otherwise not in use. See, for example, FIGS. 31–34 of U.S. Pat. No. 5,271,531. Such a lid can be designed to prevent leakage from the valve under certain conditions. The lid can also keep dust and dirt from the valve and/or can protect the valve from damage.

A dispensing closure incorporating such a pressure-openable valve provides advantages not found in other types of dispensing closures. For example, another common type of dispensing closure has a base defining a dispensing orifice which is normally occluded by a closed lid having a plug which enters into, and seals, the orifice. The lid must be lifted open to permit the product to be dispensed through the closure orifice. The lid must be manually closed after dispensing the product in order to permit the container to be carried or moved in any position other than a non-vertical position. Further, the lid must be closed in order to minimize evaporation or drying out of the product within the container. Also, the lid must be closed in order to prevent contaminants from entering the container.

Other types of dispensing closures include lift-up spouts or rotatable valve members. These features must be manipulated by the user when it is desired to open a dispensing passage and must be manipulated by the user when it is desired to close the dispensing passage.

With the above-discussed conventional types of dispensing closures that do not incorporate a pressure-openable valve, it may be possible to store the container with the closure thereon in an inverted position (with the dispensing closure at the bottom) so as to maintain the container product near the dispensing passage or orifice. This may be advantageous when the product is a rather viscous liquid because, when the inverted dispensing closure is opened, the product is already located at the dispensing passage or orifice and the dispensing time is minimized.

However, while the inverted storage of such a dispensing closure and container may speed dispensing of a viscous product, this can result in creating a rather messy condition at or around the dispensing closure passage or orifice. For example, with conventional dispensing closures that have a lid plug sealingly occluding a dispensing orifice in a closure base, inverted storage causes the inner end of the lid plug to be coated with the product. When the lid is opened, the product on the end of the plug is carried with the plug along the surface of the orifice. Some of the product sticks to the surface of the orifice and/or adjacent exterior edges of the closure base around the orifice. Some of the product also sticks to the lid plug. When the lid is subsequently closed after dispensing the product, the product on the lid plug and around the closure base orifice can create a messy condition around the exterior edge of the dispensing orifice. With the dispensing closure in the closed condition, the product around the exterior of the dispensing orifice can dry out and become somewhat hardened or encrusted during a subsequent period of non-use. This is not only aesthetically unpleasant, but it can inhibit the easy opening of the lid during subsequent use.

A pressure-openable dispensing valve advantageously eliminates or minimizes some of the above-discussed problems. Because such a valve does not have to be directly manipulated to effect its opening or closing, the user merely needs to squeeze the container to effect dispensing of the container product. Although such a simple squeezing action is generally required for dispensing a product, especially a viscous product, through any type of dispensing closure, the use of a pressure-openable valve in a dispensing closure eliminates the need to also initially, manually manipulate a finger-operable valve, spout, or lid employed with other types of conventional closures.

Because a closure with a pressure-openable dispensing valve remains closed unless the container is squeezed, the lid, if one is provided, can be left in the full open position after the consumer opens the lid for the first time. Further, the closure and container can be inverted for storage (with the dispensing closure and valve at the bottom) and with the lid fully open. Product does not leak through such a valve, and there is little or no mess on the exterior of the valve or surrounding closure surfaces.

Further, the use of a pressure-openable valve permits more accurate control of the dispensing process. Because the pressure-openable valve typically has a relatively thin membrane in which the dispensing slots are defined, there is no long orifice or passage through which the product must pass prior to discharge from the dispensing closure. Thus, the product discharges from the dispensing closure through such a pressure-openable valve relatively quickly and in substantially direct response to squeezing forces applied to the container which are readily sensed by the user as the user squeezes the container. The user has a more accurate "feel" of the relationship between the container squeezing force and the discharging product as the user squeezes the container.

Further, because the pressure-openable valve membrane defining the dispensing aperture slits is relatively thin, and because the valve can be positioned in the dispensing closure at, or very near, the most exterior surface of the closure, the user can readily observe the valve and its dispensing slits. Thus, the user can easily see the product being discharged, and the user can more readily determine how hard to squeeze the container and when to terminate the squeezing of the container.

While dispensing closures with pressure-openable dispensing valves function generally satisfactorily in applications for which they are designed, it would be desirable to provide an improved dispensing system incorporating such pressure-openable valves. With some products, it is desirable to provide some form of air-tight barrier protection to prevent discoloration or spoilage of the product. Thus, it would be desirable to provide an improved dispensing structure incorporating a dispensing valve with a barrier film or liner. It would also be advantageous to provide an improved system for opening a barrier or liner in the dispensing structure. Such an improved system should preferably not require the user to first remove a portion of the structure in order to gain access to the barrier or liner.

It would also be beneficial if such an improved dispensing structure could be easily operated to open the barrier or liner in a way that would not generate separate waste materials which would have to be handled by the consumer and discarded separately from the dispensing structure or container.

Additionally, it would be desirable to provide such an improved dispensing system with means for readily indicating to the consumer that the dispensing structure has been initially opened or tampered with.

It would also be beneficial if such an improved dispensing system could accommodate the use of a variety of valve materials in conjunction with a variety of different valve support body materials.

It would also be desirable to provide such an improved dispensing system with a design that could accommodate storage of the container and dispensing structure in an inverted (upside down) position wherein the dispensing system supports the container. This would be especially useful for maintaining the fluid product at the dispensing orifice so that, when the dispensing structure is opened, the product could be readily discharged without having to wait for the fluid product to flow downwardly toward the dispensing orifice.

Also, it would be desirable if such an improved dispensing system could be provided with a design that would accommodate efficient, high quality, large volume manufacturing techniques with a reduced product reject rate.

Further, such an improved dispensing system should advantageously accommodate its use with a variety of conventional containers having a variety of conventional container finishes, such as conventional threaded or snap-fit attachment configurations.

The present invention provides an improved dispensing structure which can accommodate designs having the above-discussed benefits and features.

SUMMARY OF THE INVENTION

According to one aspect of the present invention, a dispensing system or structure is provided for a container that has an opening to the container interior. The dispensing system includes a dispensing structure that includes a cover which has a dispensing valve over the container opening. The container opening under the dispensing valve is initially sealed closed with a membrane, and the cover extends from the container around and over the membrane. The cover includes a penetrator for penetrating the membrane when the user pushes downwardly on the cover.

According to one aspect of the invention, the membrane may be part of the dispensing structure (e.g., mounted within the dispensing structure cover below the valve). The cover, with the membrane mounted thereto, may be attached, either releasably or permanently, to the top of the container.

According to another aspect of the invention, the membrane may be mounted to the container per se across the container opening (e.g., sealingly adhered to the upper edge of the container around the container opening). Then the cover may be attached, either releasably or permanently, to the container around the membrane to position the valve over the membrane.

With either of the above-described two embodiments, although the container per se is not a component of the invention, one aspect of the invention may be characterized as providing a dispensing structure which comprises the combination of both the cover and the membrane, regardless of whether the membrane is mounted directly to the container or directly to the cover.

However, according to yet another aspect of the invention, the membrane can be mounted directly to the container, but neither the container nor the membrane per se need be regarded as a component of the invention per se. In that case, the dispensing structure per se can be defined as comprising only the dispensing cover (including the valve and penetrator carried thereon) which is adapted for mounting to the container over the membrane, but the dispensing structure need not be defined as including the membrane per se.

Further, although it is presently contemplated that the preferred embodiment of the invention employs a dispensing cover which is a separate subassembly manufactured separately from the container, it will be appreciated that the invention also contemplates providing the dispensing cover as an integral part of the container or as a unitary extension of the container.

In the presently contemplated preferred embodiment, the dispensing structure includes the cover in the form of a separate closure which is adapted to be threadingly engaged with a container or snap-fit onto a container.

Further, an optional lid may be provided for closing over the top of the dispensing cover, and such a lid may be a separate element or may be hingedly connected to the dispensing cover.

The cover includes a peripheral frame and a panel which is connected with the frame. In the preferred embodiment, the frame and panel form a unitary structure. The panel defines a dispensing aperture and is normally biased to an outwardly convex configuration as viewed from outside of the cover. The panel accommodates movement of the panel to a self-maintained, inverted, inwardly concave configuration. The dispensing valve is disposed within the cover across the dispensing aperture. The penetrator extends from the panel inwardly of the dispensing valve for penetrating the membrane when the panel is in the inwardly concave configuration.

Typically, the user pushes the panel inwardly to effect penetration of the membrane. This exposes the container interior to the underside of the dispensing valve. In the preferred embodiment, the dispensing valve is a self-sealing, pressure-openable valve of the type which is molded from an elastomeric material and which has a central portion defining two intersecting slits which open to permit flow therethrough in response to increased pressure on one side of the valve and which close to shut off flow therethrough upon removal of the increased pressure. The user can invert the container and squeeze the container to dispense the container contents through the valve.

In a preferred embodiment, the dispensing structure cover frame, panel, and penetrator are molded as a unitary structure from a first material, and the dispensing valve is molded from a second material which is bonded to the cover. The cover includes a hinge joining the periphery of the panel with the peripheral frame. The hinge is a generally annular, reduced thickness, film hinge. When the panel is pushed inwardly to the inverted, concave configuration, the dispensing structure, along with the container attached thereto, can rest on a support surface in the inverted orientation. The valve remains closed unless and until sufficient pressure is exerted within the container (e.g., as by squeezing the container) to effect discharge of the container contents through the valve.

With such a system, a lid is not required. However, if a lid is initially provided with the container and dispensing structure, the lid may be removed or maintained in a fully opened position so as to accommodate the inverted storage of the assembly. On the other hand, if desired, the lid can also be configured to accommodate inverted storage of the assembly when the lid is closed over the dispensing structure cover, whether or not the dispensing structure cover is in the inwardly concave configuration.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same, FIG. 1 is an exploded, perspective view of a first embodiment of a dispensing structure of the present invention which comprises a separate closure which has an attached lid shown in the open position and which is adapted to be threadingly engaged with a container having an opening which is sealed closed with a membrane;

FIG. 2 is a perspective view of a self-sealing, pressure-openable, slit-type valve in the closed configuration prior to installation in the closure illustrated in FIG. 1;

FIG. 3 is a top plan view of the closed valve illustrated in FIG. 2;

FIG. 4 is a side elevational view of the valve illustrated in FIG. 2, and FIG. 4 shows the valve closed in solid lines and shows the valve open in dashed lines;

FIG. 8 is a fragmentary, cross-sectional view of a second embodiment of the dispensing structure of the present invention which includes a different system for retaining the valve and which includes a different type of penetrator;

FIG. 9 is a fragmentary, perspective view of the underside of the second embodiment of the dispensing structure illustrated in FIG. 8;

FIG. 10 is a fragmentary, cross-sectional view of the second embodiment of the closure illustrated in FIGS. 8 and 9 shown in a self-maintained, inverted, inwardly concave configuration on the container to penetrate the membrane over the container opening;

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the dispensing system components of this invention are described in various positions, and terms such as upper, lower, horizontal, etc., are used with reference to these positions. It will be understood, however, that the components may be manufactured and stored in orientations other than the ones described.

Figure 5:
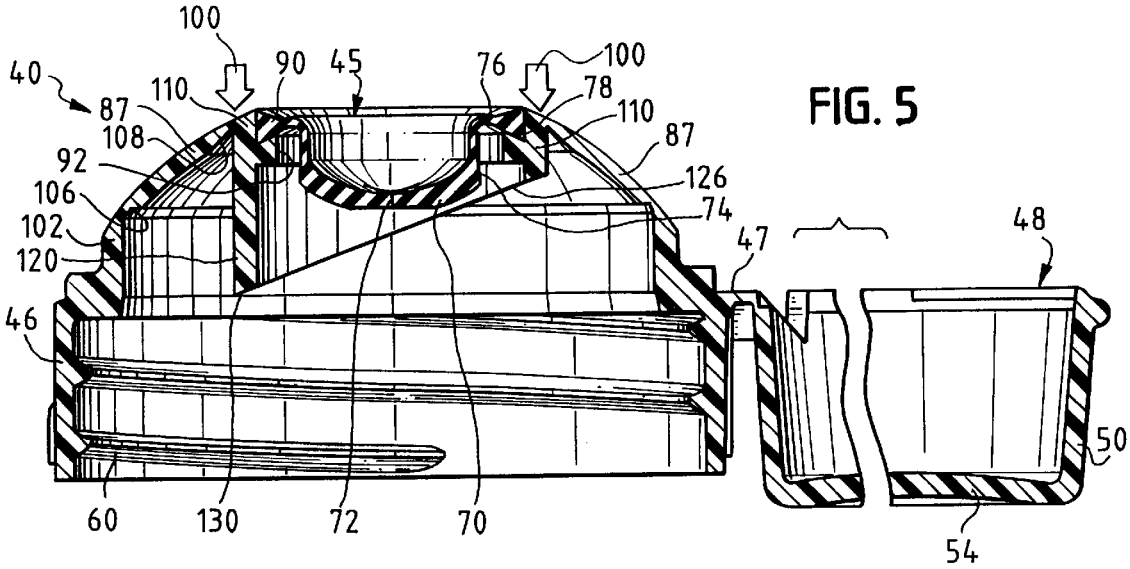
FIG. 5 is an enlarged, fragmentary, cross-sectional view of the closure shown in FIG. 1 with the lid open and prior to installation on a container.

With reference to the figures, a first embodiment of a dispensing system of the present invention is illustrated in FIGS. 1–7. The first embodiment of the dispensing system or structure includes a cover or closure 40 which is adapted to be mounted on a container 41 (FIG. 5).

The container 41 has a conventional mouth or opening 42 (FIG. 7) defined by a neck 43 or other suitable structure on the upper end of the container 41. The opening is initially occluded by a membrane 44 sealed to the top of the container neck 43. Alternatively, the membrane 44 could be adhered to the cover or closure 40 across an interior region of the closure 40 so that when the closure 40 is mounted on the container 41, the membrane 44 will seal across the container neck 43.

The container neck 43 typically has (but need not have) a circular cross-sectional configuration, and the body of the container 41 may have another cross-sectional configuration, such as an oval cross-sectional shape, for example. The container mouth or opening 42 provides access to the container interior and to a product contained therein. The product may be, for example, a liquid comestible product. The product could also be any other solid, liquid, or gaseous material, including, but not limited to, a food product, a personal care product, an industrial or household cleaning product, or other chemical compositions, e.g., compositions for use in activities involving manufacturing, commercial or household maintenance, construction, remodelling, agriculture, etc.

The membrane 40 may also be characterized as a "liner" which may be a thermoplastic film or paper material. The liner or membrane 44 may be heat-sealed or adhesively secured to the top of the container neck 43, to an interior region of the cover 40, or to both the container neck 43 and cover 40. Other suitable means of attaching the liner or membrane 44 may be employed so long as a leak-tight seal is defined across the container neck opening 42 when the cover 40 is properly mounted to the container (or, alternatively, when the cover 40 is otherwise attached integrally to the container or formed as a unitary extension thereof).

According to one aspect of the present invention, the liner or membrane 44 may be characterized as part of the dispensing structure per se. However, according to another aspect of the invention, the liner or membrane 44 may be characterized as a separate element with which the present invention dispensing structure is adapted to coact as described in detail hereinafter.

The container 41 may typically be a squeezable container having a flexible wall or walls which can be grasped by the user and squeezed or compressed to increase the internal pressure within the container so as to force the product out of the container through the closure when the closure is open. The container wall typically has sufficient, inherent resiliency so that when the squeezing forces are removed, the container wall returns to its normal, unstressed shape. Such a squeezable wall structure is preferred in many applications, but may not be necessary or preferred in other applications. Other means could be provided for pressurizing the product inside the container in order to dispense the product. For example, a manually operable plunger or piston (not illustrated) could be provided at the bottom end of the container.

The cover or closure 40 includes a dispensing valve 45 and a base or skirt 46. The dispensing structure may optionally include a lid 48. The lid 48 may be a separate element. However, preferably the lid 48 is connected to the top of the base or skirt 46 with a hinge 47. Preferably, the hinge 47 is a snap-action hinge formed integrally with the lid 48 and base 46 in a unitary structure. The illustrated snap-action hinge 47 may be a conventional type as described in U.S. Pat. Nos. 4,403,712 or 5,642,824. Other hinge structures may be employed, including a "floppy" living film hinge. However, it is preferable to employ a snap-action hinge so as to be able to readily maintain the hinge 47 in the open position during the dispensing of the container contents at the application site.

Figure 7:
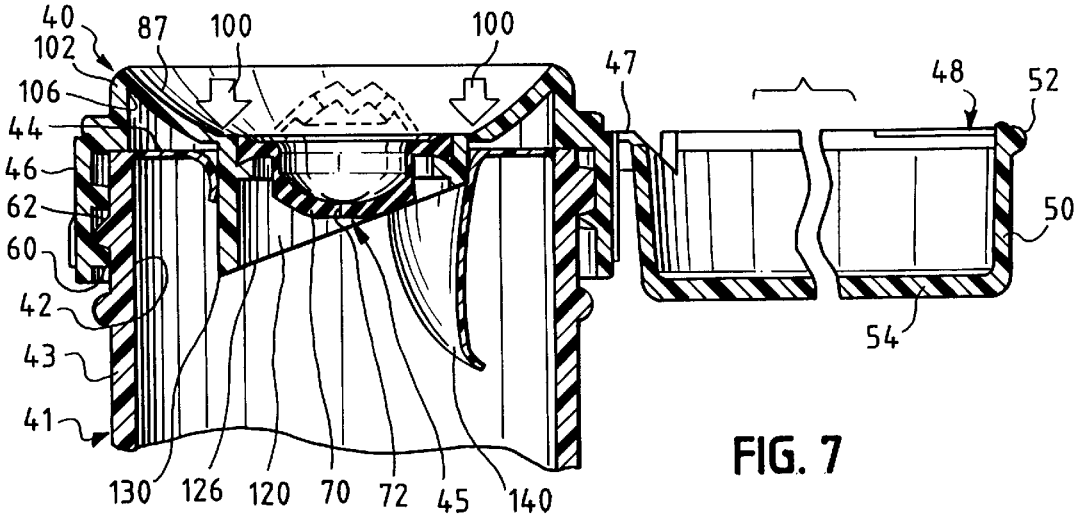
FIG. 7 is a view similar to FIG. 5, but FIG. 7 shows the closure mounted on the container and shows the panel of the closure in a self-maintained, inverted, inwardly concave configuration wherein a penetrator on the closure has penetrated the membrane across the top of the container, and FIG. 7 also shows the valve in the closed configuration in solid lines and in an open configuration in dashed lines.

Preferably, if a lid 48 is provided, the lid includes a peripheral frame or skirt comprising an outer wall 50 (FIG. 1) and a lift tab 52 (FIGS. 1, 5, and 7) at a location on the lid wall 50 which is 180 degrees from the hinge 47. The lid 48 also includes a top wall or end wall 54. As shown in FIGS. 5 and 7, the end wall 54 has a slightly dished configuration. Thus, at the periphery of the end wall 54, where the end wall 54 joins the outer wall 50, there will be a narrow, annular region of contact if the dispensing structure is placed on a support surface in an inverted orientation with the lid 48 closed over the cover 40. This will provide a stable support configuration in the inverted orientation. This has the advantage of permitting the container contents to flow or settle to the dispensing end of the container so that when the user wants to subsequently dispense the product, the user will not have to wait for the product to flow toward the dispensing end.

The cover 40 (and hinge 47 and lid 48, if provided as a unitary part thereof) may be fabricated from a synthetic, thermoplastic, polymeric material, or other materials, compatible with the container contents. The cover skirt 46 has suitable connecting means (e.g., a conventional thread 60 (FIGS. 5 and 7) or a conventional snap-fit bead (not illustrated)) for engaging suitable cooperating means, such as a thread 62 (or bead (not illustrated)) on the container neck 43 to secure the closure cover 40 to the container 41. The cover 40 and container 41 could also be welded together by induction-melting or ultrasonic melting. With such other connection systems, the configuration of the skirt 46 may be altered, or the skirt 46 may be eliminated altogether. In some applications, it may be desirable to provide the cover 40 as a direct extension of the container 41. For example, the portion of the cover may be initially molded from thermoplastic material as a unitary extension of the container 41, and subsequently, the valve would be installed therein, and the membrane 44 could be positioned and fixed within the container neck from a temporarily open bottom end of the container prior to the contents being added to the container through the temporarily open bottom end of the container and prior to the bottom end of the container being molded closed.

The preferred form of the valve 45 is illustrated FIGS. 2–4. The valve 45 is of a known design employing a flexible, resilient material which can open to dispense the product. The valve 45 may be molded from a suitable thermosetting elastomeric material, such as natural rubber and the like. Preferably, however, the valve 45 is molded from a thermoplastic elastomer based upon materials such as thermoplastic propylene, ethylene, polyurethane, and styrene, including their halogenated counterparts.

A valve which is similar to, and functionally analogous to, valve 45 is disclosed in the U.S. Pat. No. 5,439,143. However, the preferred form of the valve 45 employed in the present invention has a peripheral flange structure (described in detail hereinafter) which differs from the flange structure of the valve shown in the U.S. Pat. No. 5,439,143. The description of the valve disclosed in the U.S. Pat. No. 5,439,143 is incorporated herein by reference to the extent pertinent and to the extent not inconsistent herewith.

As illustrated in FIGS. 2–4, the valve 45 includes a flexible, central wall or face 70 which has a concave configuration (when viewed from the exterior of the closure 40) and which defines at least one, and preferably two, dispensing slits 72 extending through the central wall or face 70. A preferred form of the valve 45 has two, mutually perpendicular, intersecting slits 72 of equal length. The intersecting slits 72 define four, generally sector-shaped, flaps or petals in the concave, central wall 70. The flaps open outwardly from the intersection point of the slits 72 in response to increasing container pressure of sufficient magnitude in the well-known manner described in the U.S. Pat. No. 5,439,143 and as shown in FIGS. 4 and 7 herein.

The valve 45 includes a skirt 74 (FIG. 4) which extends outwardly from the valve central wall 70. At the outer (upper) end of the skirt 74 there is a thin, annular flange 76 (FIG. 5) which extends peripherally from the skirt 74. The thin flange 76 terminates in an enlarged, much thicker, peripheral flange 78 which has a generally dovetail shaped transverse cross section.

The valve 45 is mounted within the cover 40. To this end, the cover 40 includes a panel 87 which preferably defines a dome with a dispensing aperture or opening for receiving the valve 45. As shown in FIG. 5, the dome-shaped panel 87 defines an annular attachment region or seat 90 on a shoulder 92 which defines the opening through which a portion of the valve 45 projects. The annular seat 90 is frustoconical so as to match the adjacent surface of the valve dovetail flange 78. The bottom surface of the flange 78 is disposed on, and bonded to, the frustoconical seat 90. When the valve 45 is properly mounted within the cover 40 as illustrated in FIGS. 1 and 5–7, the central wall 70 of the valve 45 lies recessed within the cover dispensing orifice defined by the cover annular shoulder 92.

The lower periphery of the panel 87 is connected to an annular wall 102 that projects upwardly from the cover skirt 46. The panel 87 is connected to the wall 102 with a generally annular, reduced thickness film hinge 106 (FIG. 5). At the top of the panel 87, the panel 87 is connected with another, generally annular, reduced thickness film hinge 108 (FIG. 5) to an annular wall 110 around the frustoconical seat 90 and valve 45. The hinges 106 and 108 readily accommodate movement of the panel 87 from an outwardly convex configuration (as viewed from outside the cover in FIG. 5) to an inverted, inwardly concave configuration (as viewed from outside the cover in FIG. 7).

The cover 40 includes a penetrator member 120 extending inwardly from the panel 87. Preferably, the penetrator member 120 is an annular wall extending inwardly (i.e., downwardly) as an extension of the annular wall 110. The penetrator member 120 has a bottom edge 126 for piercing or severing a central portion of the membrane or liner 44.

Figure 6:
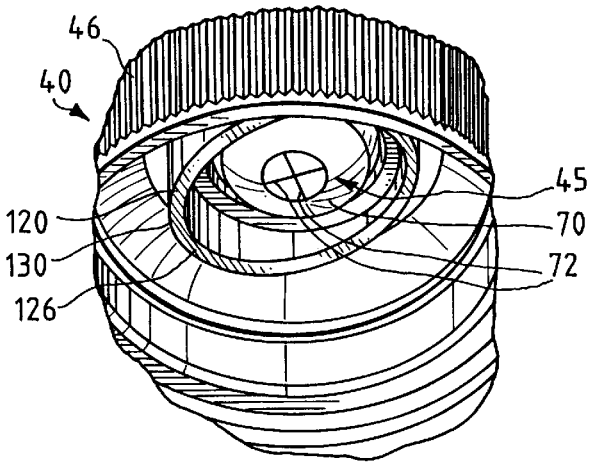
FIG. 6 is a fragmentary, perspective view of the underside of the closure shown in FIGS. 1 and 5.

The bottom edge 126 of the penetrator member or annular wall 120 has a sloping or slanting orientation which lies at an oblique angle to the membrane or liner 44. As shown in FIGS. 5 and 6, the bottom edge 126 of the penetrator member 120 has a lowermost portion 130 which defines an acute angle piercing edge portion for initially contacting, and then piercing or severing, the membrane 44.

The dispensing structure closure or cover 40 is mounted to, or formed as part of, the container 41 prior to the delivery of the package to the user. If a lid 48 is included, the lid 48 is in a closed condition, and the lid 48 then functions as a dust cover and also provides protection against accidental contact with the dome-shaped panel 87 and valve 45. The lid 48 provides these protective functions during shipping of the package, during warehousing, and while the package is on display in a store or while the package is initially being stored by the user.

The user may pivot the lid 48 to the full open position (or completely remove the lid 48 if it is not hingedly attached) so as to be able to inspect the condition of the panel 87 and valve 45. If the panel 87 is in the outwardly convex configuration, then that is an indication that the seal or membrane 44 has not been punctured.

When the user desires to open the closure or cover 40 to dispense product from the container 41, the user pushes down on the top of the cover 40 so that the penetrator member 120 pierces, punctures, or severs the central portion of the seal, liner, or membrane 120. The cover panel 87 can be moved downwardly when a force is applied to the top outer surface of the panel around the valve 45 as indicated by the arrows 100 in FIGS. 5 and 7. The dome-shaped panel 87 is pushed down and moved to the self-maintained, inverted, inwardly concave configuration by applying pressure with a finger, thumb, or with the heel of the hand at the top of the panel 87 adjacent the valve 45. Once inverted, the flexible panel 87 remains in the inverted position (FIG. 7).

As the flexible panel is pushed downwardly to the inverted position, the penetrator member 120 punctures, pierces, or otherwise severs a central portion of the seal, liner, or membrane 44 a shown in FIG. 7. Typically, the severed portion of the membrane 44 defines a downwardly hanging flap 140 which remains connected at one end to the peripheral portion of the membrane 44. As illustrated in FIG. 7, when the membrane 44 is initially pierced, the valve 45 is disposed within the container neck 43 and is in communication with the container interior.

The panel 87 of the cover 40 remains in the inverted, inwardly concave position and has an inwardly dished configuration. The container 41, with the cover 40 mounted thereon, may then be turned upside down so that the container 41 and cover 40 can be supported upside down by the end of the annular wall 102 on a support surface. This will enable the product within the container to flow down to the region of the valve 45 under the influence of gravity so that the product can be readily discharged from the container 41 when the container 41 is squeezed.

The panel 87 has two stable positions—the outwardly convex position illustrated in FIG. 5, and the inwardly concave position illustrated in FIG. 7. At any position between the two stable positions, the panel 87 is in compression and exhibits a resistance to movement between the two stable positions. The degree of resistance to movement may be defined, at least in part, by the differential surface areas of the panel 87 and the areas defined by the film hinges 106 and 108. As the panel 87 is pushed from one stable position to the other stable position, the resistance to movement is overcome by resilient compressive bowing and distortion which is accommodated by the resilient material of the cover (which may be polypropylene, for example) and by the film hinges 106 and 108.

To dispense product, the user inverts the container 41 and squeezes it to increase the pressure within the container 41 above ambient. This forces the product within the container toward the valve 45 and forces the valve 45 from the recessed or retracted position (illustrated with solid lines in FIGS. 1–7) toward an outwardly extending position (illustrated in phantom with dashed lines in FIG. 7). However, the cover panel 87 remains in the inwardly concave configuration. The outward displacement of the concave, central wall 70 of the valve 45 is accommodated by the relatively, thin, flexible, skirt 78. The skirt 78 moves from an inwardly projecting, rest position to an outwardly displaced, pressurized position, and this occurs by the skirt 78 "rolling" outwardly toward the outside of the cover 40 (toward the position illustrated in dashed lines in FIGS. 4 and 7). However, the valve 45 does not open (i.e., the slits 72 do not open) until the valve central wall 70 has moved substantially all the way to a fully extended position at or beyond the dispensing passage defined by the annular flange 92. Indeed, as the valve central wall 70 moves outwardly, the valve central wall 70 is subjected to radially inwardly directed compression forces which tend to further resist opening of the slits 72. Further, the valve central wall 70 generally retains its concave configuration as it moves outwardly and even after it reaches the fully extended position. However, when the internal pressure becomes sufficiently high, then the slits 72 of the valve 45 begin to open to dispense a stream or drop of product 73 as shown in dashed lines in FIG. 4. The product is expelled or discharged through the open slits 72.

The lid 48 may include a structure for preventing discharge of the container product through the valve 45 when the lid is closed and the container is inadvertently squeezed or subjected to impact forces which would increase the pressure within the container. In particular, a spud or seal post (not illustrated) may be provided on the lid central panel 54 to project inwardly toward the valve 45 from the lid central panel 54.

The post can have a generally cylindrical configuration, either solid or hollow. The post can terminate in an outwardly convex distal end surface that substantially conforms to the concave configuration of the outer surface of the valve central wall 70. However, even when the lid 48 is closed, the post distal end surface would be spaced outwardly from the valve central wall 70 by a small amount which accommodates an initial, small, outward displacement of the valve central wall 70 into engagement with the post distal end surface before the valve slits 72 can open. Thus, when the closed container is subjected to external forces which increase the container internal pressure, the valve central wall 70 is forced outwardly against the conforming end surface of the seal post. This occurs inwardly of the outermost position at which the valve slits 72 would open. Thus, the valve 45 remains sealed closed in such over-pressure situations.

In a contemplated design employing such a seal post, as the valve 45 articulates or moves outwardly from the fully recessed position illustrated in solid lines in FIGS. 1–7 to a more outwardly position, the periphery of the valve central wall 70 and portion of the skirt 74 may tend to be compressed slightly in the radially inwardly direction to accommodate the movement of the valve. The slight reduction in the diameters of portions of the valve may be characterized as somewhat of a "collapsing" motion which can occur around the lid seal post and which would facilitate the sealing of the valve 45 by the lid seal post. The sealing engagement between the seal post distal end surface and the valve central wall 70 serves to provide a highly effective seal which prevents unwanted dispensing of product into the lid region of the closure.

Preferably, the lid seal post would be smooth and free of indentations or other structure which could collect unwanted product, and the smooth surface of the seal post would provide a highly effective sealing surface for engagement with the valve 45.

The outward movement of the valve central wall 70 from the recessed position to the more outwardly position against the seal post would temporarily increase the internal volume of the system. This volume increase can reduce the rate of pressure increase or peak pressure, and this can help accommodate the over-pressure condition resulting from external impact forces during shipping or handling.

Another, somewhat similar structure in a lid for preventing the valve from opening when the lid is closed is disclosed in U.S. Pat. No. 5,213,236. This may be preferable in some applications. In other designs, such as the embodiment illustrated in FIGS. 1–7 herein, the lid 48 need not necessarily have any structure for engaging the valve to inhibit opening of the valve during accidental overpressure incidents.

In a preferred embodiment, the cover 40, lid 48, and hinge 47 are molded from a first material, such as polypropylene, and the valve 45 is molded from a second material, such as a thermoplastic elastomer. According to one technique, a multi-shot injection molding process is used to first mold the dispensing structure as a "preform" in a first injection phase in a mold. This includes the optional lid 48 and hinge 47 in the preferred embodiment illustrated. The preform is then transferred to a second, differently shaped cavity generally within the same mold wherein the second material (e.g., thermoplastic elastomer) is injection-molded (over-molded) in a second phase onto and against the annular attachment surface or seat 90 of the preform to form the valve 45. The valve 45 is preferably attached or bonded to the seat 90 by the creation of a weld defined by the interface solidification of melted portions of the first and/or second materials. The valve 45 may be molded with the slits 72 defined therein. However, in a presently preferred method, the valve slits 72 are subsequently cut into the wall or face 70 by suitable conventional or special techniques.

Descriptions of multi-shot, multi-material injection molding techniques are set forth in "Multi-Material Injection Saves Time, While Cutting Costs," MODERN PLASTICS, Mar. 19, 1994 (author: Peter Mapleston), in "Molding Many Parts Into One," Product Design and Development, Dec. 19, 1995, page 16 (author: Jay Rosenberg), and in U.S. Pat. No. 5,439,124.

The above-described molding techniques need not be employed. Other techniques may be used. For example, according to a preferred method for making the dispensing structure, the cover 40, lid 48, and hinge 47 can be initially molded from a first material in a mold assembly pursuant to the process for molding a body, lid, and hinge disclosed in the European Patent No. 0 570 276. Subsequently, the valve 45 can be molded from a second material against the seat 90 in the same mold assembly after repositioning an internal mold element. The European Patent No. 0 570 276 discloses how an internal mold element 12 can be repositioned to accommodate the molding of a second material into a ring 8 against the closure body. This technique can be employed according to the present invention for molding the valve 45 in a mold assembly against the previously molded cover 40. The description of the method and apparatus disclosed in the European Patent No. 0 570 276 is incorporated herein by reference thereto to the extent pertinent and to the extent not inconsistent herewith.

The use of a thermoplastic elastomer for injection molding the valve 45 is desirable in many applications because a thermoplastic elastomer provides suitable characteristics which accommodate the desired opening and closing of the valve 45 in response to the container interior pressure changes.

In the preferred embodiment, the valve 45 is bonded to the seat 90, and the cover 40 may be characterized as a one-piece system or integral system. Because the valve 45 is molded directly into the cover seat 90, separate manufacture, storage, and handling of the valve 45 is not required. Costly manufacturing processes for assembling a small valve into the small cover are eliminated. The one-piece system eliminates or minimizes potential defects arising from improper assembly. The one-piece dispensing system is less likely to leak or become loose.

A second embodiment of the dispensing structure of the present invention is illustrated in FIGS. 8–10. The dispensing structure includes a cover 40A having a skirt 46A, an annular wall 102A, and a dome-shaped panel 87A. The dome-shaped panel 87A has an outer periphery which is connected via a film hinge 106A to the top of the annular wall 102A, and the panel 87A has an inner periphery which is connected with a film hinge 108A to an annular wall 113A. The elements of the second embodiment of the cover 40A as so far described are substantially identical with, and function in substantially the same manner as, corresponding elements in the first embodiment of the cover 40 described above in detail with reference to FIGS. 1–7.

A second annular wall 117A is spaced radially inwardly of the annular wall 113A. The annular wall 113A and annular wall 117A define between them an outwardly (upwardly) facing groove 114A. An upwardly facing, frustoconical seat or seating surface 90A extends inwardly from the annular wall 117A for receiving a slit-type valve 45A that has substantially the same configuration as the valve 45 described above with reference to the first embodiment illustrated in FIGS. 1–7. The valve 45A includes a peripheral flange 78A disposed on the seat 90A.

The valve 45A is retained on the seat 90A by means of a separate retainer element 150A. The retainer element 150A has an annular outer wall 152A received within the groove 114A in a snap-fit engagement effected by cooperating annular bead and groove configurations defined by the retainer annular wall 152A and the adjacent annular wall 117A.

The retainer 150A has an inner, annular wall 158A with a frustoconical lower end surface adapted to engage and clamp the upper surface of the flange 78A of the valve 45A.

The second embodiment of the dispensing structure illustrated in FIGS. 8–10 is a multi-piece or multi-component structure which readily accommodates the manufacture of the components from different materials and/or by different processes. The components can be manufactured at different times and/or in different locations, and then the components can later be brought together for final assembly.

The second embodiment of the dispensing structure also includes a penetrator 120A defined by a plurality of struts 160A. In the embodiment illustrated in FIGS. 8–10, there are four struts 160A arranged in a conical array with one end of each strut 160A joining the cover 40A adjacent the periphery of the dispensing aperture around the valve 45A. The other, lower, end of each strut 160A merges with the other struts to define a piercing point or member 162A.

FIG. 10 illustrates the second embodiment of the closure on a container 41A and in an actuated position wherein the penetrator 120A has pierced a membrane or liner 44A which had been initially sealed across the top of the neck of the container 41A. The flexible panel 87A has been pushed downwardly into a self-maintained, inverted, inwardly concave configuration, and the penetrator 120A has pierced, severed, or penetrated the membrane or liner 44A to effect communication between the container interior and the valve 45A.

Figure 11:
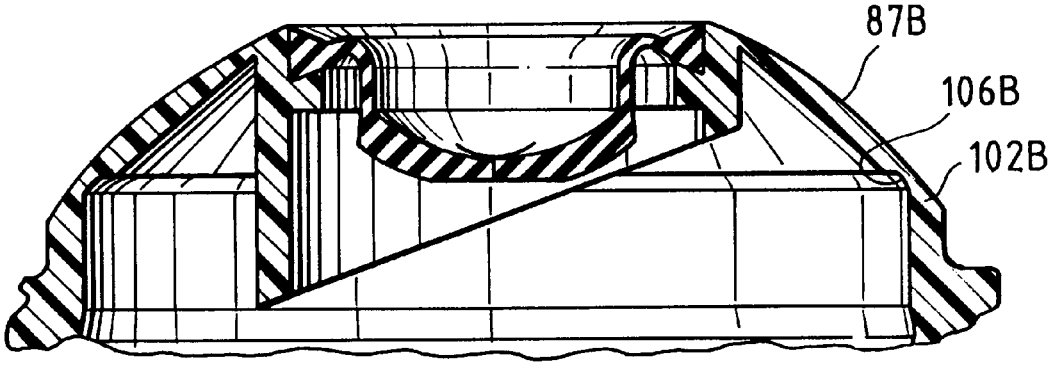
FIG. 11 is a fragmentary, cross-sectional view of a third embodiment of a dispensing structure of the present invention wherein the cover panel has a different configuration.
Figure 12:
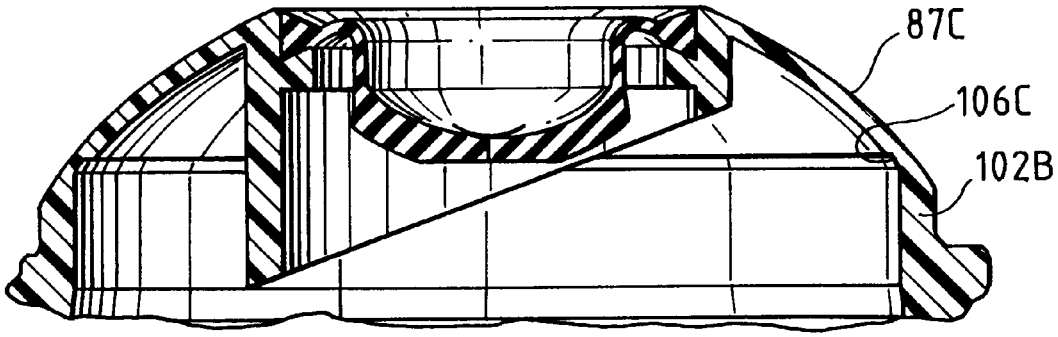
FIG. 12 is a fragmentary, cross-sectional view of a fourth embodiment of a dispensing structure of the present invention wherein the cover panel has yet another configuration.
Figure 13:
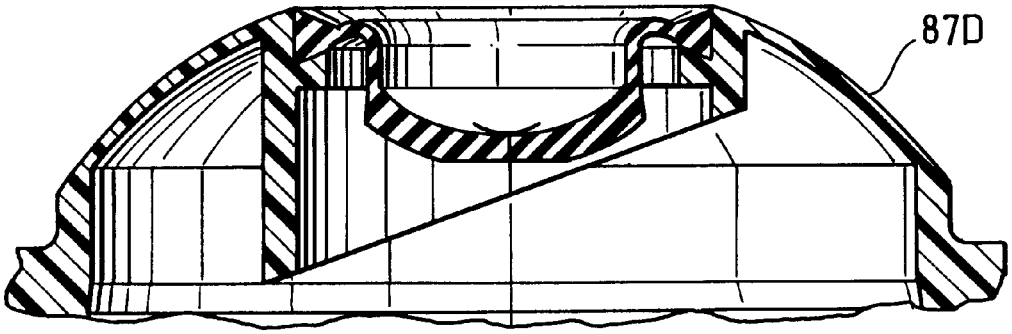
FIG. 13 is a fragmentary, cross-sectional view of a fifth embodiment of a dispensing structure of the present invention wherein the cover panel has yet another configuration.

FIGS. 11, 12, and 13 illustrate third, fourth, and fifth embodiments of the invention respectively. Each of the third, fourth, and fifth embodiments has substantially the same design as the first embodiment described above with reference to FIGS. 1–7 with the exception that the third, fourth, and fifth embodiments each includes an inverting panel which differs slightly from the panel 87 employed in the first embodiment illustrated in FIGS. 1–7.

In particular, in the third embodiment illustrated in FIG. 11, the panel is designated by reference characters 87B. The panel 87B has only one peripheral hinge, namely, a film hinge 106B which joins the lower, outer periphery of the panel 87B to an annular wall 102B of the cover. The panel 87B has a non-uniform thickness, and the panel 87B becomes thinner at the upper end of the panel adjacent the dispensing orifice and valve area.

The fourth embodiment of the dispensing structure illustrated in FIG. 12 includes a panel 87C which has a generally uniform cross-sectional thickness. One, outer peripheral film hinge 106C is provided to connect the lower, outer periphery of the panel 87C with an annular wall 102B of the cover. In one presently contemplated design, the cross-sectional thickness of the panel 87C may be between about 0.10 inch and about 0.025 inch when the cover is molded from polypropylene.

The fifth embodiment illustrated in FIG. 13 includes a flexible panel 87D which has a uniform cross-sectional thickness and which is very thin. No film hinges are employed in this embodiment.

Each of the alternate embodiments illustrated in FIGS. 11, 12, and 13 accommodates movement of the panel to a self-maintained, inverted, inwardly concave configuration (generally corresponding to the inverted configuration illustrated for the first embodiment as shown in FIG. 7).

According to one aspect of the invention, each of the above-described first through fifth embodiments may be characterized as a dispensing structure for the end of a container, and the pierceable liner or membrane may also be characterized as an element of the invention per se. However, according to another aspect of the invention, each of the first through fifth embodiments of the dispensing structure need not include the liner or membrane per se as an element of the invention. Rather, the dispensing structure may be characterized as adapted for use with a container that has a liner or membrane initially sealed thereto.

Further, each of the embodiments may be readily modified to accommodate other ways for attaching the dispensing end structure to the container. As previously described, the dispensing end structure can be mounted to the container with a threaded engagement to easily accommodate removal if desired. On the other hand, the dispensing structure could be mounted to the container in a substantially permanent manner. Further, in some applications, it may be desirable to provide the dispensing structure as a unitary extension of the container.

It will be readily observed from the foregoing detailed description of the invention and from the illustrations thereof that numerous other variations and modifications may be effected without departing from the true spirit and scope of the novel concepts or principles of this invention.

What is claimed is:

1. A dispensing structure for a container that has an opening to the container interior, said dispensing structure comprising:

a membrane for occluding said container opening; and a cover for extending around said container opening over said membrane, said cover including (a) a peripheral frame, (b) a panel that (i) defines a dispensing aperture, (ii) is connected with said frame, (iii) is normally biased to an outwardly convex configuration as viewed from outside said cover, and (iv) accommodates movement of said panel to a self-maintained, inverted, inwardly concave configuration, (c) a dispensing valve in said cover across said dispensing aperture, and (d) a penetrator extending from said panel inwardly of said dispensing valve for penetrating said membrane when said panel is in said inwardly concave configuration.

2. The dispensing structure in accordance with claim 1 in which said dispensing structure membrane is initially sealed to said container end over said opening to occlude said opening.

3. The dispensing structure in accordance with claim 1 in which said dispensing structure cover is formed separately from said container; and said dispensing structure membrane is a separate article initially sealed to said cover below said penetrator.

4. The dispensing structure in accordance with the claim 1 in which said dispensing structure cover is a unitary part of said container; and said dispensing structure cover extends from said container as a unitary part of an end of said container.

5. The dispensing structure in accordance with claim 1 in which said dispensing structure cover includes a skirt with an interior thread for threadingly engaging an exterior thread on said container.

6. The dispensing structure in accordance with claim 1 in which said dispensing structure further includes a lid for accommodating movement between (1) a closed position over said cover dispensing orifice, and (2) an open position away from said lid closed position.

7. The dispensing structure in accordance with claim 6 in which said dispensing structure includes a hinge connecting said lid with said cover frame.

8. The dispensing structure in accordance with claim 6 in which said lid is capable of supporting said dispensing structure upside down on a support surface.

9. The dispensing structure in accordance with claim 1 in which said penetrator includes an inner, annular wall around said dispensing aperture and includes an edge defined along a bottom portion of said inner, annular wall at an oblique angle to said membrane.

10. The dispensing structure in accordance with claim 1 in which said penetrator includes a plurality of struts arranged in a conical array with one end of each said strut joining said cover adjacent the periphery of said dispensing aperture and with the other end of each said strut merging with the other struts to define a piercing member.

11. The dispensing structure in accordance with claim 1 in which said dispensing structure cover frame, flexible panel, and penetrator are molded as a unitary structure from a first material; and said dispensing valve is molded from a second material and includes (1) a peripheral portion molded against, and bonded to, said cover, and (2) a central portion extending from said peripheral portion across said dispensing aperture.

12. The system in accordance with claim 11 in which said valve peripheral portion is attached to said cover with a weld defined by the interface solidification of melted portions of said first and second materials.

13. The dispensing structure in accordance with claim 12 in which said first material is polypropylene and said second material is a thermoplastic elastomer.

14. The dispensing structure in accordance with claim 1 in which said dispensing valve is molded from a synthetic polymer as a separate element; and said dispensing structure cover includes a retainer mounted to clamp said valve in said cover.

15. The dispensing structure in accordance with claim 1 in which said dispensing valve is molded from a thermoplastic elastomer; and said dispensing valve has a central portion with a dispensing aperture defined by two intersecting slits which open to permit flow therethrough in response to increased pressure on one side of said valve and which close to shut off flow therethrough upon removal of the increased pressure.

16. The dispensing structure in accordance with claim 1 in which said cover includes an annular seat which is defined around said dispensing aperture and which receives said valve.

17. The dispensing structure in accordance with claim 1 in which said panel is flexible and is generally dome-shaped when said panel is normally biased in said outwardly convex configuration.

18. The dispensing structure in accordance with claim 1 in which said cover includes an a hinge joining the periphery of said panel with said peripheral frame.

19. The dispensing structure in accordance with claim 18 in which said hinge is a generally annular, reduced thickness, film hinge joining the periphery of said dome-shaped panel to said peripheral frame.

20. The dispensing structure in accordance with claim 1 in which said panel is defined between two, spaced-apart, generally concentric film hinges.

21. The dispensing structure in accordance with claim 1 in which said panel is generally dome-shaped; and said dispensing aperture is located at the top of said dome shape.

22. The dispensing structure in accordance with claim 1 in which said panel is flexible and has a non-uniform thickness.

23. A dispensing structure for a container that has an opening to the container interior, said dispensing structure comprising:

a membrane sealed to said container for occluding said container opening;

a cover for extending around said container opening over said membrane, said cover including (a) a peripheral frame mounted to said container, (b) a flexible panel that (i) is connected with said frame, (ii) is normally biased to an outwardly convex configuration as viewed from outside said cover, (iii) defines a dispensing aperture at the top of said convex configuration, (iv) defines an annular seat around said dispensing aperture, and (v) accommodates flexure of said flexible panel to a self-maintained, inverted, inwardly concave configuration, (c) a dispensing valve disposed on said seat in said cover across said dispensing aperture, and (d) a penetrator extending from said flexible panel inwardly of said dispensing valve for penetrating said membrane when said flexible panel is in said inwardly concave configuration; and a lid for accommodating movement between (1) a closed position over said cover dispensing orifice, and (2) an open position away from said lid closed position.

24. The dispensing structure in accordance with claim 23 in which said dispensing structure includes a hinge connecting said lid with said cover frame.

25. The dispensing structure in accordance with claim 23 in which said lid is capable of supporting said dispensing structure upside down on a support surface.

26. The dispensing structure in accordance with the claim 23 in which said dispensing structure cover is removably attached to said container.

27. The dispensing structure in accordance with claim 26 in which said dispensing structure cover includes a skirt with an interior thread for threadingly engaging an exterior thread on said container.

28. The dispensing structure in accordance with claim 23 in which said penetrator includes an inner, annular wall around said dispensing aperture and includes an edge defined along a bottom portion of said inner, annular wall at an oblique angle to said membrane.

29. The dispensing structure in accordance with claim 23 in which said penetrator includes a plurality of struts arranged in a conical array with one end of each said strut joining said cover adjacent the periphery of said dispensing aperture and with the other end of each said strut merging with the other struts to define a piercing member.

30. A dispensing structure for a container that has an opening to the container interior, which opening is initially sealed closed with a membrane, said dispensing structure comprising:

a cover for extending around said container opening over said membrane, said cover including (a) a peripheral frame, (b) a panel that (i) defines a dispensing aperture, (ii) is connected with said frame, (iii) is normally biased to an outwardly convex configuration as viewed from outside said cover, and (iv) accommodates movement of said panel to a self-maintained, inverted, inwardly concave configuration, (c) a dispensing valve in said cover across said dispensing aperture, and (d) a penetrator extending from said flexible panel inwardly of said dispensing valve for penetrating said membrane when said panel is in said inwardly concave configuration.

31. The dispensing structure in accordance with the claim 30 in which said dispensing structure cover includes a peripheral skirt that extends downwardly past the periphery of said membrane when said cover is disposed on said container.

32. The dispensing structure in accordance with claim 30 in which said dispensing structure is separate from said container and membrane; and said cover includes a skirt with an interior thread for threadingly engaging an exterior thread on said container.

33. The dispensing structure in accordance with claim 30 in which said dispensing structure further includes a lid for accommodating movement between (1) a closed position over said cover dispensing orifice, and (2) an open position away from said lid closed position.

34. The dispensing structure in accordance with claim 33 in which said dispensing structure includes a hinge connecting said lid with said cover frame.

35. The dispensing structure in accordance with claim 30 in which said penetrator includes an inner, annular wall around said dispensing aperture and includes an edge defined along a bottom portion of said inner, annular wall at an oblique angle to said membrane.

36. The dispensing structure in accordance with claim 30 in which said penetrator includes a plurality of struts arranged in a conical array with one end of each said strut joining said cover adjacent the periphery of said dispensing aperture and with the other end of each said strut merging with the other struts to define a piercing member.

37. The dispensing structure in accordance with claim 30 in which said dispensing structure cover frame, panel, and penetrator are molded as a unitary structure from a first material; and said dispensing valve is molded from a second material and includes (1) a peripheral portion molded against, and bonded to, said cover, and (2) a central portion extending from said peripheral portion across said dispensing aperture.

38. The system in accordance with claim 37 in which said valve peripheral portion is attached to said cover with a weld defined by the interface solidification of melted portions of said first and second materials.

39. The dispensing structure in accordance with claim 38 in which said first material is polypropylene and said second material is a thermoplastic elastomer.

40. The dispensing structure in accordance with claim 30 in which said dispensing valve is molded from a synthetic polymer as a separate element; and said dispensing structure cover includes a retainer mounted to clamp said valve in said cover.

41. The dispensing structure in accordance with claim 30 in which said cover includes an annular seat which is defined around said dispensing aperture and which receives said valve.

42. The dispensing structure in accordance with claim 30 in which said panel is flexible and is generally dome-shaped when said panel is normally biased in said outwardly convex configuration.

43. The dispensing structure in accordance with claim 30 in which said cover includes an a hinge joining the periphery of said panel with said peripheral frame.

44. The dispensing structure in accordance with claim 43 in which said hinge is a generally annular, reduced thickness, film hinge joining the periphery of said dome-shaped panel to said peripheral frame.

45. The dispensing structure in accordance with claim 30 in which said panel is defined between two, spaced-apart, generally concentric film hinges.

46. The dispensing structure in accordance with claim 30 in which said panel is flexible and has a non-uniform thickness.

* * * * *